US007509982B2

(12) United States Patent
Grantham

(10) Patent No.: US 7,509,982 B2
(45) **Date of Patent: *Mar. 31, 2009**

(54) VAPOR RECOVERY SYSTEM WITH IMPROVED ORVR COMPATIBILITY AND PERFORMANCE

(75) Inventor: Rodger P. Grantham, Springfield, MO (US)

(73) Assignee: Vapor Systems Technologies, Inc., Springboro, OH (US)

( * ) Notice: Subject to any disclaimer, the term of this patent is extended or adjusted under 35 U.S.C. 154(b) by 174 days.

This patent is subject to a terminal disclaimer.

(21) Appl. No.: 11/672,814

(22) Filed: Feb. 8, 2007

(65) Prior Publication Data

US 2007/0193648 A1 Aug. 23, 2007

Related U.S. Application Data

(63) Continuation-in-part of application No. 10/970,558, filed on Oct. 21, 2004, now Pat. No. 7,174,926, which is a continuation-in-part of application No. 10/684,051, filed on Oct. 10, 2003, now Pat. No. 6,810,922.

(51) Int. Cl.
*B65B 31/00* (2006.01)
*B65B 3/04* (2006.01)
*B67C 3/02* (2006.01)

(52) U.S. Cl. ..... 141/59; 141/287; 141/301

(58) Field of Classification Search ..... 141/46, 141/59, 98, 286, 287, 301, 302; 251/281, 251/282, 330, 331

See application file for complete search history.

(56) References Cited

U.S. PATENT DOCUMENTS 3,768,777 A 10/1973 Hechler, IV
3,915,206 A * 10/1975 Fowler et al. ..... 141/59
4,056,131 A 11/1977 Healy
4,057,085 A 11/1977 Shihabi
5,035,271 A 7/1991 Carmack et al.
5,040,577 A 8/1991 Pope
5,141,037 A 8/1992 Carmack et al.
5,197,523 A 3/1993 Fink, Jr. et al.
5,285,744 A 2/1994 Grantham et al.
5,537,911 A 7/1996 Ohlrogge et al.

(Continued)

FOREIGN PATENT DOCUMENTS

GB 2311768 8/1997

*Primary Examiner*—Timothy L Maust
*Assistant Examiner*—Nicolas A Arnett
(74) *Attorney, Agent, or Firm*—Stevens & Showalter LLP

(57) ABSTRACT

A fueling and associated vapor recovery system maintains the same, or lower, vacuum level in the vapor hose during ORVR vehicle refueling as that seen during a non-ORVR refueling. A valve assembly is made as either a part of the end of the vapor recovery hose assembly, a separate unit that is placed between the hose assembly and the nozzle, or incorporated directly into the nozzle. The valve assembly is biased to one position by a spring to which is attached a sliding valve member. The force of the spring is sufficient to keep the valve member in the original position when refueling non-ORVR vehicles so that the vapor hose is unobstructed and an air bleed hole is closed. When refueling an ORVR vehicle, the elevated vacuum level moves the valve member to a second position which blocks off the vapor hose from the vacuum pump and opens up the vapor hose to the air bleed hole.

14 Claims, 9 Drawing Sheets

U.S. PATENT DOCUMENTS 5,564,466 A * 10/1996 Aoyama et al. ..... 137/493.8
5,592,963 A 1/1997 Bucci et al.
5,592,979 A 1/1997 Payne et al.
5,620,031 A 4/1997 Dalhart et al.
5,626,649 A 5/1997 Nanaji
5,636,667 A 6/1997 Young et al.
5,655,576 A 8/1997 Leininger et al.
5,676,181 A * 10/1997 Healy ..... 141/59
5,678,614 A 10/1997 Grantham
5,720,325 A 2/1998 Grantham
5,765,603 A 6/1998 Healy
5,782,275 A 7/1998 Hartsell, Jr. et al.
5,803,136 A 9/1998 Hartsell, Jr.
5,843,212 A 12/1998 Nanaji
5,857,500 A 1/1999 Payne et al.
5,860,457 A 1/1999 Andersson
5,871,651 A 2/1999 McSpadden
5,944,067 A 8/1999 Andersson
5,988,232 A 11/1999 Koch et al.
6,044,873 A * 4/2000 Miller ..... 141/59
6,059,856 A 5/2000 Ohlrogge et al.
6,070,156 A 5/2000 Hartsell, Jr.
6,082,415 A 7/2000 Rowland et al.
6,095,204 A 8/2000 Healy
6,102,085 A 8/2000 Nanaji
6,103,532 A 8/2000 Koch et al.
6,123,118 A 9/2000 Nanaji
6,151,955 A 11/2000 Ostrowski et al.
6,332,483 B1 12/2001 Healy
6,334,470 B2 1/2002 Healy
6,532,999 B2 3/2003 Pope et al.
6,810,862 B2 * 11/2004 Bergsma ..... 123/519
6,810,922 B1 11/2004 Grantham
6,923,221 B2 * 8/2005 Riffle ..... 141/59
6,941,978 B2 * 9/2005 Riffle ..... 141/7
7,174,926 B1 * 2/2007 Grantham ..... 141/59

* cited by examiner

VAPOR RECOVERY SYSTEM WITH IMPROVED ORVR COMPATIBILITY AND PERFORMANCE

CROSS REFERENCE TO RELATED APPLICATIONS

This application is a continuation-in-part of U.S. patent application Ser. No. 10/970,558 filed Oct. 21, 2004 entitled VAPOR RECOVERY SYSTEM WITH IMPROVED ORVR COMPATIBILITY AND PERFORMANCE, now U.S. Pat. No. 7,174,926, which is incorporated by reference herein in its entirety and is a continuation-in-part of U.S. patent application Ser. No. 10/684,051, filed Oct. 10, 2003 and entitled VAPOR RECOVERY SYSTEM WITH IMPROVED ORVR COMPATIBILITY AND PERFORMANCE, now U.S. Pat. No. 6,810,922, which is incorporated by reference herein in its entirety.

BACKGROUND OF THE INVENTION

The present invention relates generally to vapor recovery systems associated with the fueling of vehicles. More particularly, the present invention relates to a modification made to an assist type of vapor recovery system to improve the performance and compatibility of the system when it is used for refueling vehicles that have on board refueling vapor recovery (ORVR) systems.

In fuel dispensing systems, such as those used for delivering gasoline to the fuel tank of a vehicle, environmental protection laws require that vapors emitted from the tank during the fuel dispensing process be recovered. Fuel is customarily delivered through a nozzle via a fuel hose and vapors are recovered from the nozzle via a vapor hose that conveys the vapors to the storage tank from whence the fuel came. In what is referred to as a balanced system, the vapors are forced through the vapor hose by the positive pressure created in the vehicle tank as the fuel enters it. In other systems, referred to as assist type systems, the vapor is pumped from the vehicle tank and forced into the storage tank by a vapor recovery system connected to the vapor hose. Currently, many fuel dispensing pumps at service stations are equipped with vacuum assisted vapor recovery systems that collect fuel vapor vented from the fuel tank filler pipe during the refueling operation and transfer the vapor to the fuel storage tank.

Onboard, or vehicle carried, fuel vapor recovery and storage systems (commonly referred to as onboard refueling vapor recovery (ORVR) systems) have been developed wherein the ullage or headspace in the vehicle fuel tank is vented through a charcoal-filled canister so that the vapor is absorbed by the charcoal. Subsequently, the fuel vapor is withdrawn from the canister into the engine intake manifold for mixture and combustion with the normal fuel and air mixture. The fuel tank headspace must be vented to enable fuel to be withdrawn from the tank during vehicle operation. In typical ORVR systems, a canister outlet is connected to the intake manifold of the vehicle engine through a normally closed purge valve. The canister is intermittently subjected to the intake manifold vacuum by opening and closing the purge valve between the canister and intake manifold. A computer which monitors various vehicle operating conditions, controls the opening and closing of the purge valve to assure that the fuel mixture established by the fuel injection system is not overly enriched by the addition of fuel vapor from the canister to the mixture.

Fuel dispensing systems at service stations having vacuum assisted vapor recovery systems that are unable to detect ORVR systems waste energy, increase wear and tear, ingest excessive air into storage tanks and cause excessive pressure buildup in the piping and storage tanks due to the expanded volume of hydrocarbon saturated air. Refueling of ORVR equipped vehicles using such fuel dispensing systems can be deleterious for both the vapor recovery efficiency of the vapor recovery system and the durability of some of the system components. The refueling of an ORVR equipped vehicle deprives the vapor recovery system of gasoline vapors intended to be returned to the storage tank, typically located underground. Since gasoline vapor is not available in the required quantities, the vapor pump of an assist-type system will pump air back into the storage tank. The air pumped back into the storage tank vaporizes liquid fuel in the storage tank resulting in pressurizing the ullage space of the storage tank so that fuel vapors are then vented to the atmosphere as polluting emissions.

The balance type of vapor recovery system is one of the known types of vapor recovery systems that attempts to avoid these problems. As described above, balanced systems do not use vapor pumps, but simply allow the free exchange of vapor between gasoline tanks of vehicles being refueled and storage tanks from which gasoline is being pumped. Since air is not forced into the storage tank when a fuel dispensing system having a balanced vapor recovery system is used to refuel an ORVR equipped vehicle, the vapor growth problem is avoided and, in fact, the storage tank pressures are typically reduced by the removal of liquid and possibly vapor. The reduction in vapor flow rate when refueling an ORVR vehicle is about 100% (i.e., no vapor or air flow to the storage tank).

One known type of assist vapor recovery system attempts to avoid the storage tank pressurization problem by sensing the presence of ORVR equipped vehicles during refueling and using this information to turn off the vapor pump during the refueling of ORVR equipped vehicles. The system's ability to recognize a vehicle's ORVR system and adjust the fuel dispenser's vapor recovery system accordingly, eliminates problems associated with redundant operation of two vapor recovery systems, i.e., the dispenser's assist type vapor recovery system and the vehicle's ORVR system, for one fueling operation. Examples of this type of system are disclosed in U.S. Pat. Nos. 5,782,275 and 5,992,395, issued to Gilbarco and hereby incorporated by reference. The reduction in vapor or air flow rate during refueling of an ORVR equipped vehicle will be 100% if the vapor pump is turned off; however, some initial run time is required to sense the ORVR system and to turn the vapor pump off. The particular system of the '275 patent utilizes a hydrocarbon sensor to determine if an ORVR fueling event is occurring and the particular system of the '395 patent utilizes a pressure sensor to determine if an ORVR fueling event is occurring. If an ORVR system is detected, the sensor generates a signal that is used to turn the vapor pump off.

Another example of an assist vapor recovery system is described in U.S. Pat. No. 6,095,204, issued to Healy and hereby incorporated by reference. The '204 patent claims a fuel dispenser configured to deliver fuel to a fuel tank of a vehicle including a vapor recovery system having a vapor recovery path for removing fuel vapor during a fueling operation. A vapor controller is also claimed with a pressure sensor operatively associated with the fuel dispenser for sensing an increase in vacuum in the vapor recovery system associated with the vehicle working in opposition to the vapor recovery system for the fuel dispenser with the pressure sensor providing a pressure signal to a vapor recovery controller. A vacuum relief valve setting, in combination with a selected vacuum regulation setting for a chamber of the vapor flow control, produces an air return rate at 75% of the liquid gasoline delivery rate. In this manner, the volume of pure air drawn into the nozzle will only result in liquid gasoline evaporation underground sufficient to bring the total final volume back to a level equal to the liquid volume dispensed. Therefore vent emissions are avoided and vapor recovery system efficiency is maintained.

Another type of known assist vapor recovery system utilizes a vapor flow restrictor built into the nozzle of a fuel dispenser to decrease the vapor flow back to the storage tank during an ORVR refueling event. The nozzle for such a system utilizes a flexible boot to engage the filler neck of a vehicle, but unlike a balance system, an air-tight seal is prevented. If an air-tight seal were present when a vapor pump is being used in conjunction with an ORVR vehicle, relatively high vacuum levels develop within the vapor space of the nozzle. These abnormally high vacuum levels cause abnormal operation of the automatic shut-off mechanism in the nozzle. The nozzle for such a system utilizes either a check valve or holes in the boot itself to limit the amount of vacuum to which the nozzle is exposed. Such vacuum relief measures allow the vacuum level to increase to a detectable level within the nozzle and the elevated vacuum level is used to operate a flow restrictor in the vapor flow path. The exact reduction in vapor (air) flow rate during an ORVR refueling with such a system is from 25% to 78% depending on the exact configuration and fueling flow rate.

Another type of assist system is described in U.S. patent application Ser. No. 10/820,288 filed Apr. 8, 2004, claiming priority to U.S. Provisional Patent Application Ser. No. 60/461,097 filed Apr. 8, 2003, entitled ORVR compatible vacuum assist fuel dispensers and assigned to the assignee of the present application. That system utilizes an assist-type of nozzle and a balance-type flexible boot to seal against the filler neck of the vehicle being refueled. This arrangement results in relatively high vacuum levels in the nozzle vapor space. To accommodate those vacuum levels, the shut-off mechanism is modified. Since the nozzle boot is sealed against the vehicle's filler neck, the vapor recovery system will not ingest appreciable air into the storage tank. However, the vapor flow rate will not be reduced completely by 100% as with a balance system because the vapor pump will be capable of pumping some vapor from the vehicle's fuel tank. The reduction in vapor flow rate is typically about 90% with such a system.

The above-described assist vapor recovery system effectively blocks the inlet or nozzle end of the vapor hose resulting in relatively high vacuum levels in the vapor hose itself. The system described in the '204 patent does so similarly, but to a lesser degree. The vacuum levels in the vapor hose during refueling of an ORVR vehicle will be about ten times higher than the vacuum levels in the vapor hose when refueling a vehicle that is not equipped with an ORVR system. In addition, elevated vacuum levels will be present in the entire length of the vapor hose due to the drastically reduced vapor flow rate. The exterior of the vapor hose is also subjected to the fluid pressure since typically the fluid carrying hose surrounds it in a coaxial arrangement. The exterior pressure combined with the elevated interior vacuum levels presents a condition that promotes the collapse of the vapor hose tubing.

Moreover, the current trends in the industry are to increase the amount of ethanol used in gasoline fuel blends which deteriorates the mechanical properties of the material used in the vapor hose tubing. These factors, in combination with market movements toward single hose dispensers which increases the flexing cycle on the vapor hose tubing, can result in the collapse and/or failure of the vapor hose tubing. Such problems could become systemic and present a significant issue that must be addressed.

SUMMARY OF THE INVENTION

These and other problems with known fuel dispensing and associated vapor recovery systems have been overcome by the ORVR compatibility assembly of the present application. The ORVR compatibility assembly maintains vacuum in the vapor hose at substantially the same or slightly lower vacuum levels in the vapor hose during an ORVR vehicle refueling as compared to those experienced during a non-ORVR refueling event.

The ORVR compatibility assemblies of the present application include valve assemblies contained in housings that can be made as either parts of the end of vapor recovery hose assemblies, separate units that can be placed between hose assemblies and nozzles or incorporated directly into the nozzles. The ORVR compatibility assembly in one embodiment includes a diaphragm mounted within a chamber and a sealing member coupled to the diaphragm. The diaphragm is moveable between open and closed positions with the sealing member in the closed position closing an air bleed passage and in the open position opening the air bleed passage to ambient atmosphere, the diaphragm being biased toward the closed position. When the pressure on a first side of the diaphragm is reduced to a predetermined level, the diaphragm with the sealing member moves from the closed position to the open position so that a valve assembly is moved from its first position to its second position to inhibit flow through the primary vapor passage and vent the primary vapor passage through the air bleed passage when the diaphragm with the sealing member moves to the open position.

The ORVR compatibility assembly in another embodiment includes a valve assembly moveable between first and second positions, the first position permitting the uninterrupted flow of vapors through a primary vapor passage and the second position inhibiting the flow of vapors through the primary vapor passage, the valve assembly being biased toward the first position. An air bleed passage is in fluid communication with the primary vapor passage and a sealing member is associated with the air bleed passage and moveable between open and closed positions, the sealing member in the closed position closing the air bleed passage. When the air pressure in the primary vapor passage is reduced to a predetermined level, the sealing member moves to the open position, the valve assembly moves from the first position to the second position and the primary vapor passage is vented through the air bleed passage.

The ORVR compatibility assembly in still another embodiment includes a valve assembly moveable between first and second positions, the first position permitting the uninterrupted flow of vapors through the primary vapor passage and the second position inhibiting the flow of vapors through the primary vapor passage, the valve assembly being biased toward the first position. A diaphragm is mounted within a chamber and coupled to the valve assembly and a secondary vapor passage is in fluid communication with the chamber and the primary vapor passage. An air bleed passage is in fluid communication at a first end with the primary vapor passage and a sealing member is moveable between open and closed positions, the sealing member in the closed position sealing a second end of the air bleed passage, the sealing member in the open position opening the second end to ambient atmosphere when the valve assembly is in the second position. The sealing member is moved between the closed and open positions by the valve assembly moving between the first position and the second position. When the air pressure in the chamber is reduced to a predetermined level, the diaphragm and the valve assembly coupled thereto move from the first position to the second position and thereby inhibit flow in the valve assembly through the primary vapor passage and vent the primary vapor passage through the air bleed passage when the sealing member is moved to the open position.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
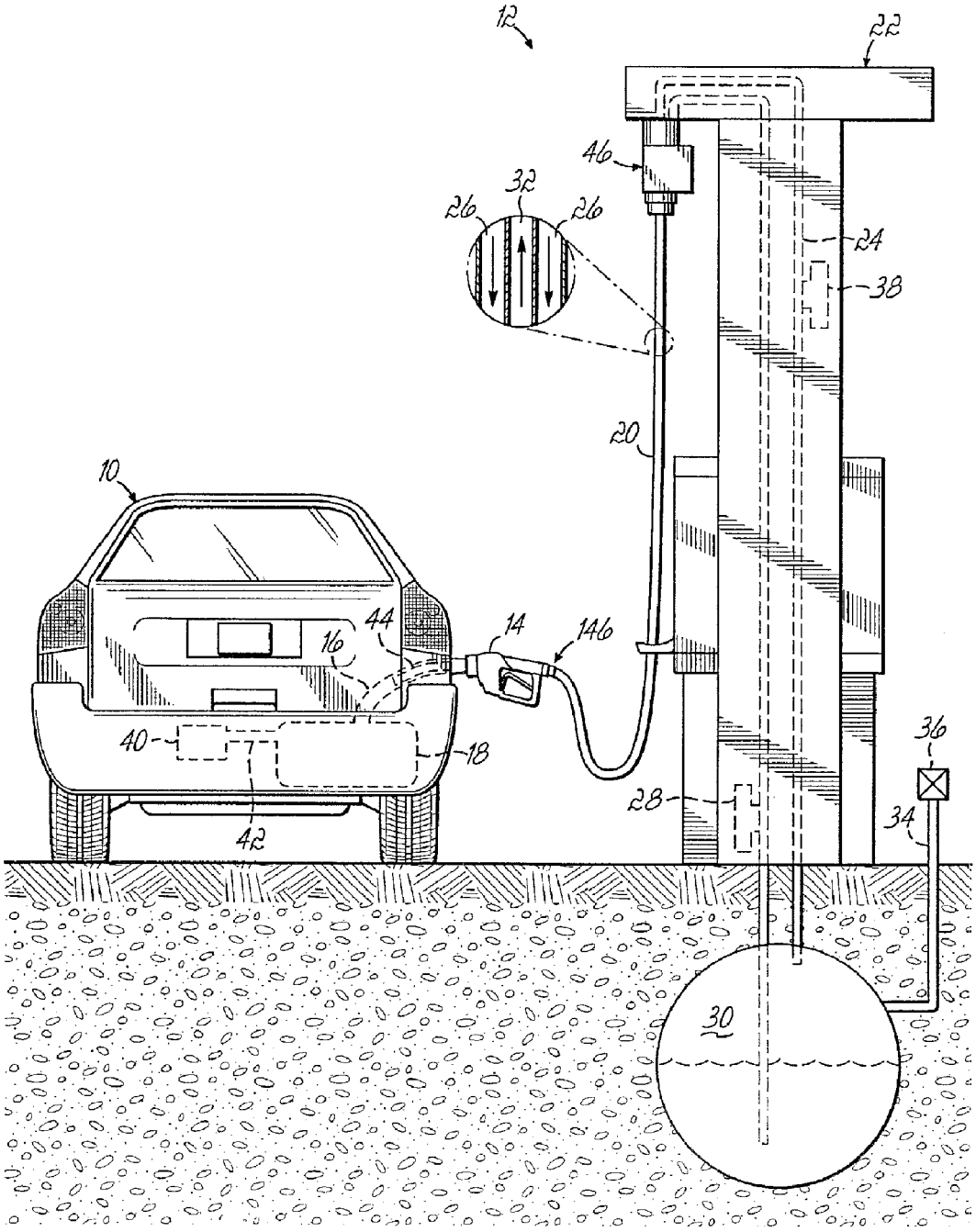
FIG. 1 is a fueling system for a vehicle including an ORVR compatibility assembly in accordance with the present invention.

Referring to FIG. 1, a vehicle 10 is shown being fueled with a fueling system 12. A nozzle 14 is shown inserted into a filler pipe 16 of a fuel tank 18 of the vehicle 10 during the fueling operation.

A fuel delivery hose 20 is connected to the nozzle 14 on one end and to a fueling system island 22 on the opposite end. The fueling system 12 includes a vapor recovery system 24. As shown by the cut-away view of the interior of the fuel delivery hose 20, an annular fuel delivery passageway 26 is formed within the fuel delivery hose 20 for delivering fuel by a pump 28 from an underground storage tank 30 to the nozzle 14. A central, tubular vapor passage 32 forming part of the vapor recovery system 24 is also within the fuel delivery hose 20 for transferring fuel vapors expelled from the fuel tank 18 of the vehicle 10 to the underground storage tank 30 during refueling of the vehicle 10. The fuel delivery hose 20 is illustrated as having the internal vapor passage 32 with the fuel delivery passage 26 concentrically surrounding it.

As shown in FIG. 1, the underground storage tank 30 includes a vent pipe 34 and a pressure vent valve 36 for venting the underground tank 30 to the atmosphere. The valve 36 vents the tank 30 to air at about +3.0 inches $H_2O$ or at about −8.0 inches $H_2O$.

A vapor recovery pump 38 provides a vacuum in the vapor passage 32 for removing fuel vapor during a refueling operation. The vapor recovery pump 38 may be placed anywhere along the vapor recovery system 24 between the nozzle 14 and the underground fuel storage tank 30. Vapor recovery systems utilizing vapor recovery pumps of the type shown and described herein are well known in the industry and are commonly utilized for recovering vapor during refueling of vehicles which are not equipped with on-board vapor recovery (ORVR) systems. The vehicle 10 shown in FIG. 1 being fueled includes an ORVR system 40. The invention of the present application makes the fueling system 12 compatible with vehicles equipped with ORVR systems, such as the vehicle 10.

The ORVR system 40 of the vehicle 10 has a vapor recovery inlet 42 extending into the fuel tank 18. As the fuel tank 18 fills, pressure within the tank 18 increases and forces vapors into the ORVR system 40 through the vapor recovery inlet 42. ORVR systems may also use a check valve (not shown) along the filler pipe 16 to further prevent loss of vapors from the filler pipe 16.

When vehicles that are not equipped with ORVR systems are refueled using the fueling system 12, fuel vapors forced from the tank 18 by liquid fuel rushing in are drawn from the tank 18 through a vapor passage (not shown) in the nozzle 44 of the nozzle 14 and a vapor passage in the nozzle 14 to the tubular vapor passage 32 of the hose 20. Thus, the vapor recovery system 24 draws the fuel vapors through the vapor passage 32 and ultimately into the underground fuel storage tank 30. This is the conventional operation of vapor recovery systems when refueling vehicles that are not equipped with ORVR systems.

According to the invention of the present application, an ORVR compatibility assembly 46 is included in the vapor recovery system 24 of the fueling system 12 to make the fueling system 12 compatible with vehicles equipped with ORVR systems during refueling ORVR equipped vehicles. As shown in FIG. 1, the ORVR compatibility assembly 46 is located on the hose 20 at the end opposite from the nozzle 14; however, the compatibility assembly 46 can be placed between the hose 20 and the nozzle 14, be incorporated directly into the nozzle 14 or essentially be placed anywhere in the vapor path of the vapor recovery system 24 of the fueling system 12.

Figure 2:
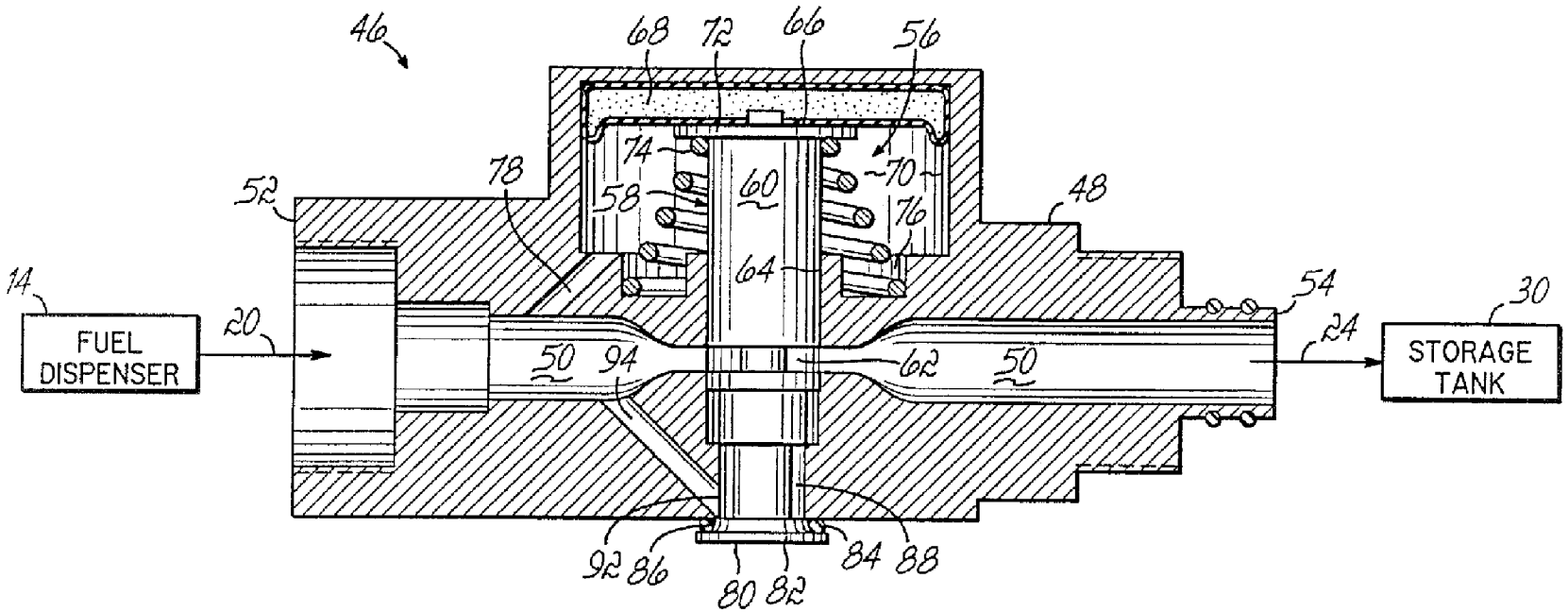
FIG. 2 is a cross-sectional view of a first embodiment of an assembly in a first position for use in a vapor recovery system of the fueling system of FIG. 1.
Figure 3:
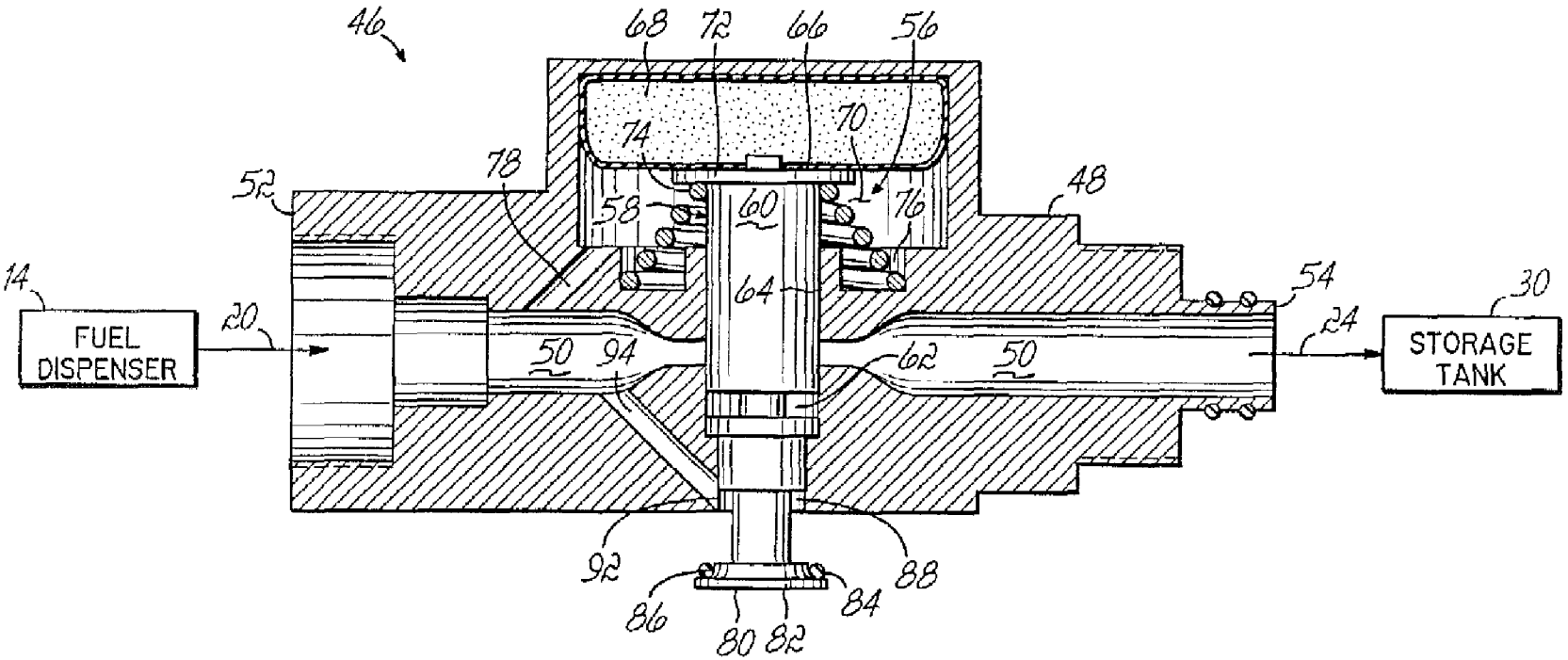
FIG. 3 is a cross-sectional view of the assembly of FIG. 2 in a second position.

Referring to FIGS. 2 and 3, the compatibility assembly 46 according to a first embodiment of the present application includes a housing 48 with a primary vapor passage 50 therethrough and in communication with the vapor passage 32 of the hose 20. A first end of the primary vapor passage 50 in the assembly 46, referred to herein as the upstream end 52, is connected through the hose 20 to the fuel nozzle 14 so that it is in communication with the fuel tank 18 of the vehicle 10. A second end of the primary vapor passage 50, referred to herein as the downstream end 54, is in communication with the storage tank 30.

A valve assembly 56 is mounted for reciprocal movement in the housing 48 and intersects the primary vapor passage 50 in the assembly 46. The valve assembly 56 includes a sliding valve member 58 having a generally cylindrical portion 60 and a valve passage 62 which allows vapor flow through the primary vapor passage 50 when the valve assembly 56 is in a first position as shown in FIG. 2. The sliding valve member 58 reciprocates within a bore 64 in the housing 48 to a second position as shown in FIG. 3 in which the cylindrical portion 60 of the valve member 58 blocks or inhibits vapor flow through the primary vapor passage 50.

A proximal end 66 of the valve member 58 is connected to a diaphragm 68, bellows or other expansible member which is captured within a chamber 70 in the housing 48. A plate 72 is mounted between the proximal end 66 of the valve member 58 and the diaphragm 68. A conical spring 74 is mounted between the plate 72 on the valve member 58 and an annular groove 76 in the housing 48. The spring 74 urges or biases the valve member 58 upwardly as illustrated (it is noted that the assembly 46 can be mounted in substantially any orientation) so that the valve assembly 56 is urged toward the first position shown in FIG. 2. A secondary vapor passage 78 connects the chamber 70 to the primary vapor passage 50 upstream from the valve assembly 56 as shown in FIG. 2. In an alternate embodiment, the secondary vapor passage 78 is connected to the chamber 70 and the primary vapor passage 50 downstream from the valve assembly 56 as shown in FIG. 4.

A distal end 80 of the valve member 58 includes a stop 82 juxtaposed to the housing 48. An O-ring 84 is seated on a beveled surface 86 of the stop 82 for sealing an annular pocket 88 in the housing 48. A stem 90 projects from the valve member 58 through the pocket 88 and is connected to the stop 82. In the first position of the valve assembly 56 as shown in FIGS. 2 and 4, the O-ring 84 and stop 82 are seated against the housing 48 to seal off an air bleed port 92 connected to an air bleed passage 94. The air bleed passage 94 is in communication with the primary vapor passage 50 upstream from the valve assembly 56. In the second position of the valve assembly 56 as shown in FIG. 3, the valve member 58 translates to extend the stop 82 from the sealing configuration with the housing 48 thereby opening the air bleed passage 94 for communication between the ambient atmosphere and the primary vapor passage 50.

Figure 4:
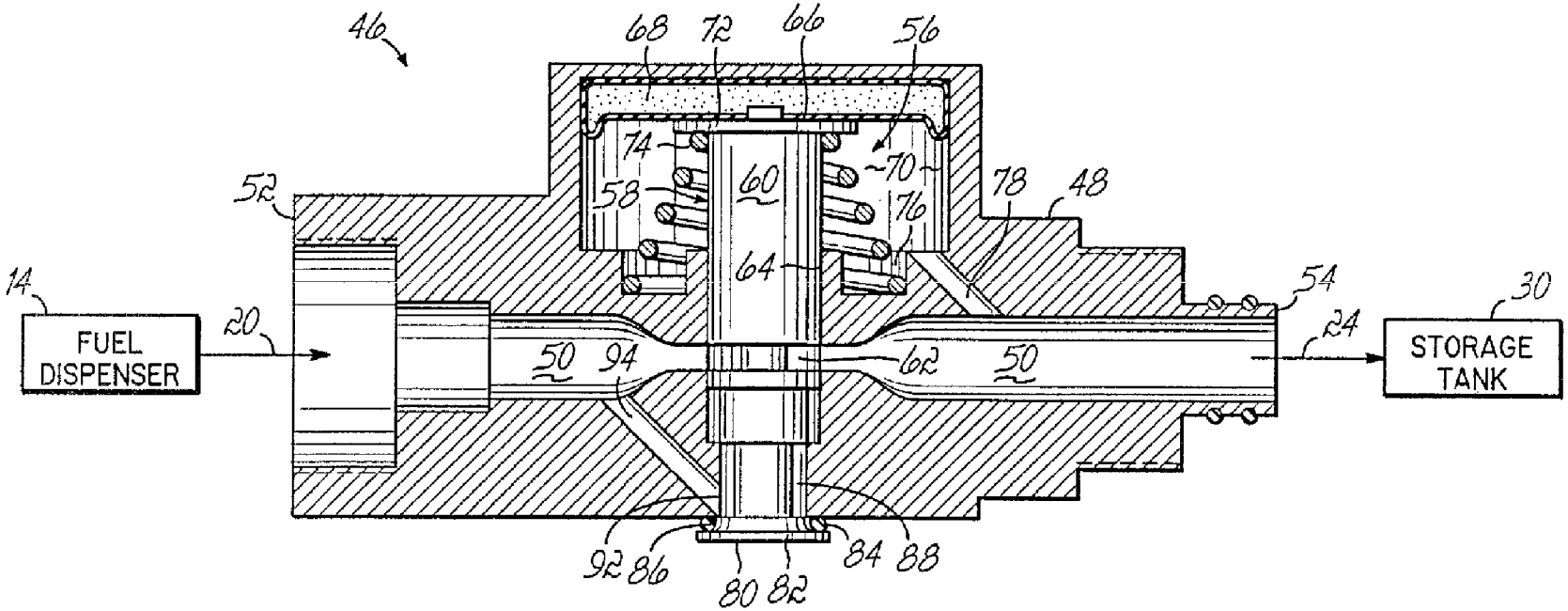
FIG. 4 is a cross-sectional view of a second embodiment, an alternative embodiment of the assembly of FIG. 3 in the first position.

In operation, the force of the spring 74 on the plate 72 and diaphragm 68 keeps the valve member 58 in the first position as shown in FIGS. 2 and 4 when refueling non-ORVR vehicles so that the primary passage 50 in the assembly 46 is unobstructed and the air bleed port 92 is closed. When refueling non-ORVR vehicles, the vapor recovery system 24 in the fueling system 12 draws fuel vapors from the vehicle fuel tank 18 and pumps them into the ullage in the underground storage tank 30. When refueling an ORVR 40 equipped vehicle 10, elevated vacuum levels in the vapor passage 32 of the hose 20 result from the vacuum pump 38 in the vapor recovery system 24 in combination with the ORVR system 40. The elevated vacuum levels are communicated through the primary and secondary vapor passages 50, 78 to the chamber 70. As a result of the elevated vacuum levels (or reduced pressure) in the chamber 70, the diaphragm 68 expands or moves within the chamber 70 as shown in FIG. 3. The movement of the diaphragm 68 likewise moves the valve member 58 toward the second position and overcomes the bias of the spring 74 while the reduced pressure or elevated vacuum condition exists in the chamber 70.

As a result of the movement of the diaphragm 68 and plate 72, compression of the spring 74 and translation of the valve member 58, the primary vapor passage 50 is blocked off because the valve passage 62 no longer provides for the flow of vapor in the primary vapor passage 50 through the assembly 46. Moreover, the vacuum of the vapor recovery system 24 is blocked from communicating with the ORVR system 40. The valve member 58 in the second position as shown in FIG. 3 blocks off the primary vapor passage 50 from the vacuum pump 38 of the vapor recovery system 24 and opens up the primary vapor passage 50 to the air bleed port 92. The size of the air bleed port 92 can be adjusted for compatibility with the containment pumping action of the ORVR filler neck to maintain the desired vacuum level in the passage 32 in vapor hose 20 to keep the valve member 58 in the second position.

As shown in FIG. 4, in a second embodiment, the diaphragm chamber 70 is connected by the secondary vapor passage 78 downstream from the valve assembly 56. As such, when the elevated vacuum level or decreased pressure in the chamber 70 causes the valve member 58 to move to the second position, the vacuum level on the downstream end 54 or pump side of the valve member 58 will increase substantially and hold the valve member 58 in the second position until the pump 38 is stopped. In the embodiment of FIG. 4, the air bleed port 92 into the primary vapor passage 50 could be made as large as desired and even to the point of reducing the vacuum in the passage 32 of the vapor hose 20 below the valve assembly 56, including the nozzle vapor space to nearly zero. Nevertheless, in any embodiment of this invention, reduction of vapor flow in the vapor passage 32 to the storage tank 30 would be at or near 100%.

Figure 5:
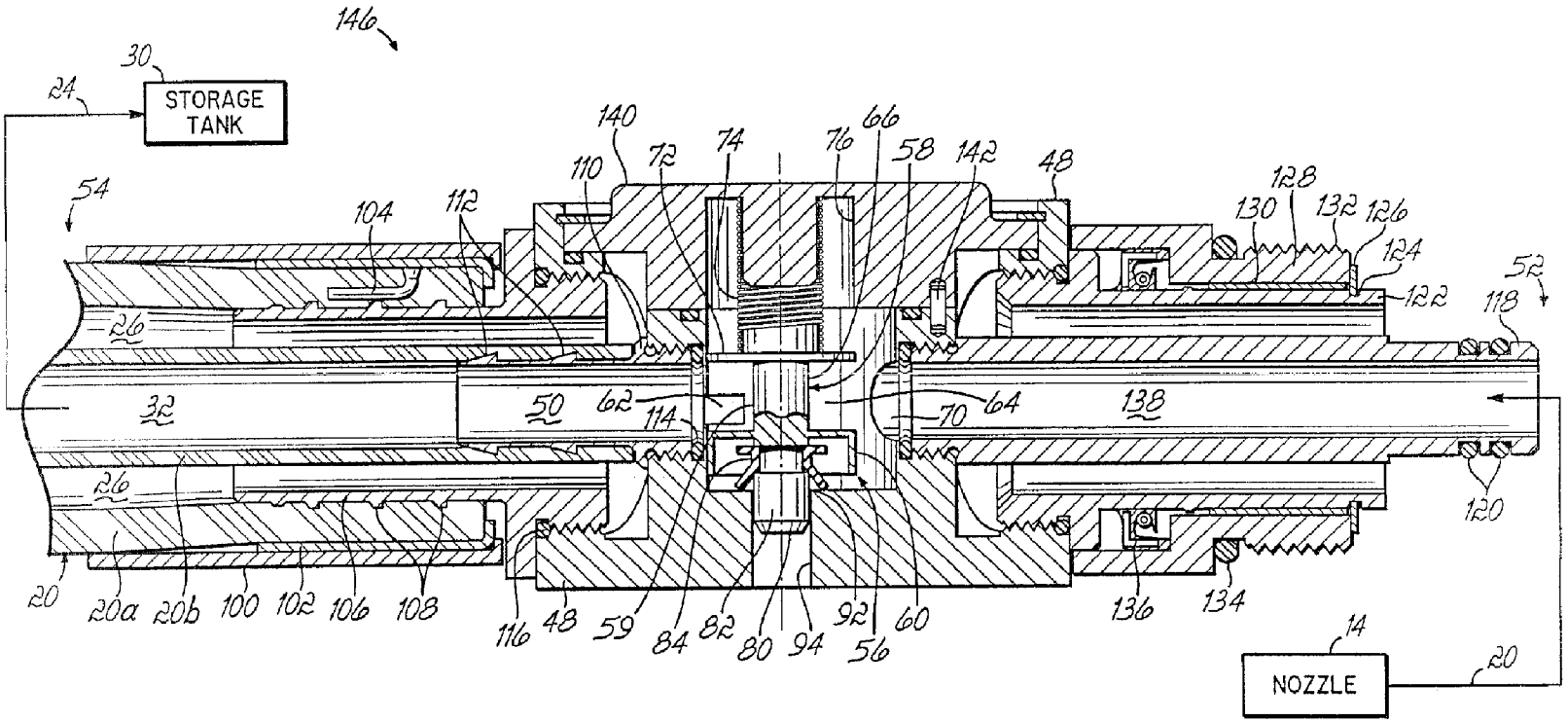
FIG. 5 is a cross-sectional view of a third embodiment of an assembly for use in a vapor recovery system of the fueling system of FIG. 1.
Figure 6:
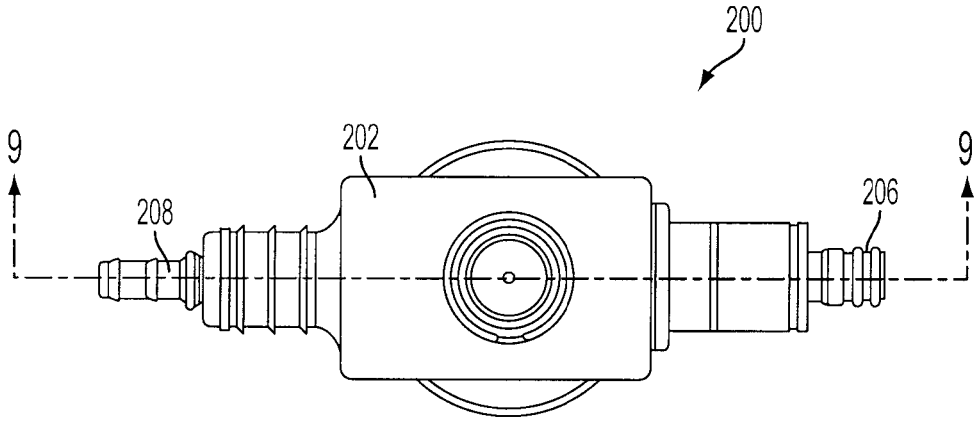
FIG. 6 is a top view of a fourth embodiment of an assembly for use in a vapor recovery system of the fueling system of FIG. 1.
Figure 7:
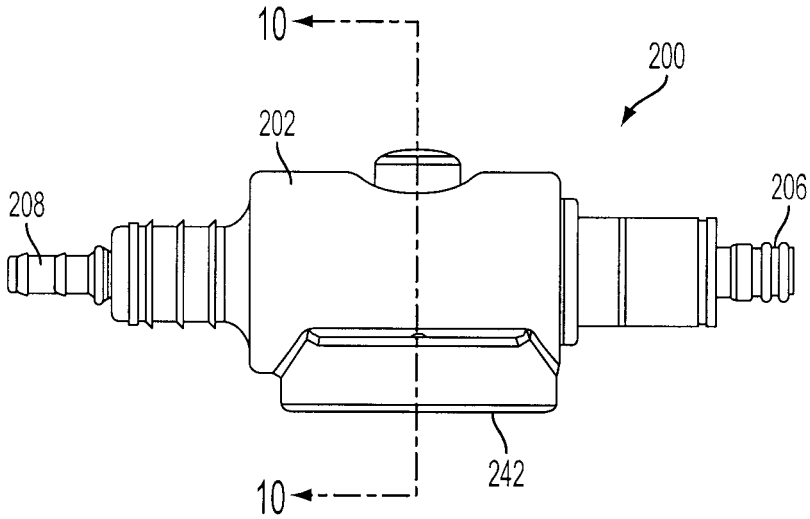
FIG. 7 is a front view of the assembly of FIG. 6.
Figure 8:
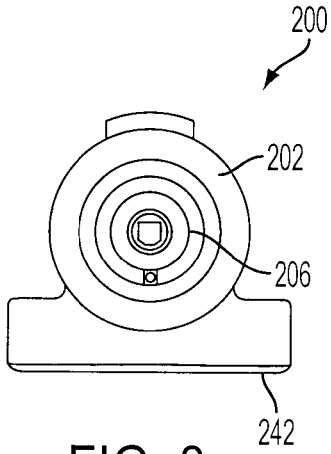
FIG. 8 is an end view of the assembly of FIG. 7.
Figure 9:
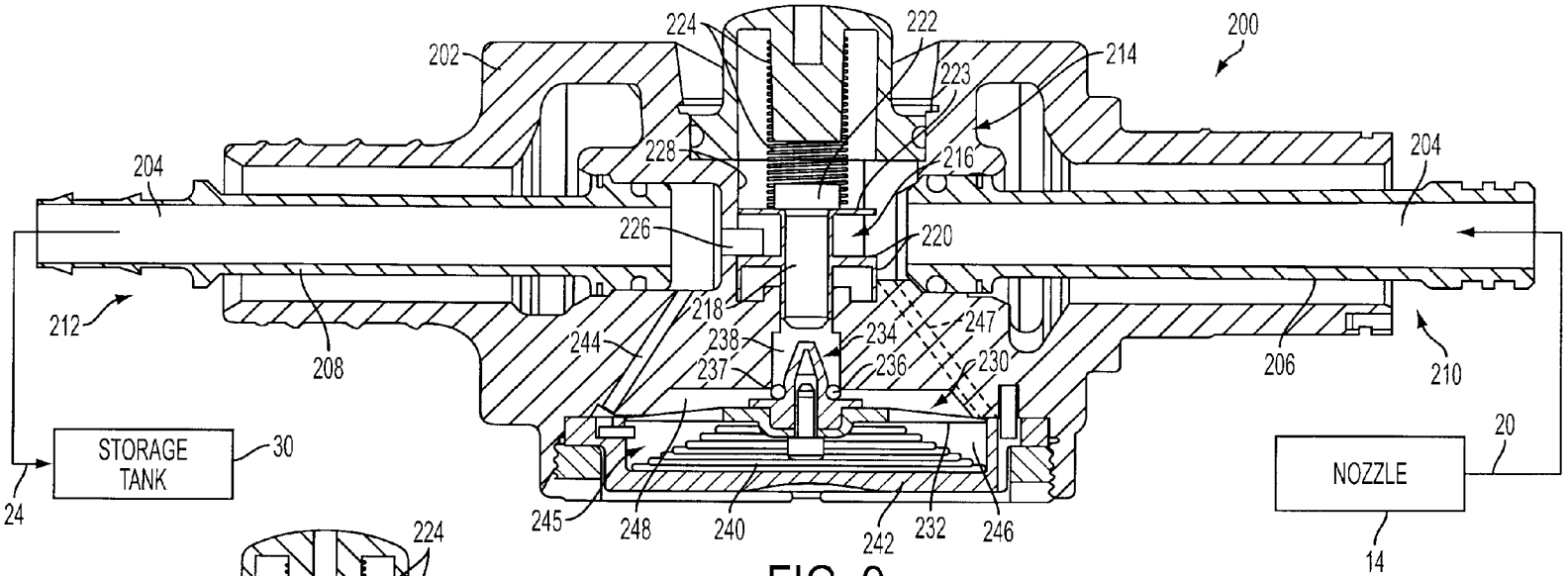
FIG. 9 is a sectional view of the assembly of FIG. 6 taken along the section line 9-9 of FIG. 6.
Figure 10:
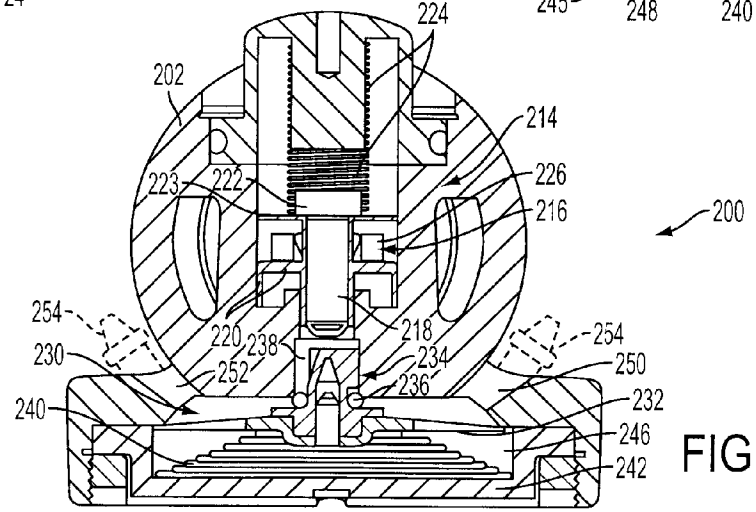
FIG. 10 is a sectional view of the assembly of FIG. 7 taken along the section line 10-10 of FIG. 7.

A third embodiment of an ORVR compatibility assembly 146 according to the invention of the present application is shown in FIG. 5. In one embodiment, the ORVR compatibility assembly 146 can be located on the hose 20 adjacent the nozzle 14 of FIG. 1; however, the compatibility assembly 146 can also be located on the hose 20 and spaced from the nozzle 14, incorporated directly into the nozzle 14, or located essentially anywhere in the vapor path of the vapor recovery system 24 of the fueling system 12 as long as the primary vapor passage 50 and a central axial passageway 138 (described later herein) are coupled to vapor passage 32. As illustrated, the assembly 146 is located in a fitting that connects the hose 20 to the nozzle 14.

Referring to FIG. 5, the compatibility assembly 146 according to this embodiment of the invention of the present application includes a valve body 48 with a primary vapor passage 50 therethrough and in communication with the vapor passage 32 in the hose 20. A first end of the primary vapor passage 50 in the assembly 146, referred to herein as the upstream end 52, is connected through the central axial passageway 138 to the fuel nozzle 14 and, a second end of the primary vapor passage 50, referred to herein as the downstream end 54, is in communication with the underground storage tank 30 via the hose 20.

The assembly 146 according to the embodiment of FIG. 5 may be coupled to the hose 20 at the downstream end 54 by a ferrule sleeve 100 surrounding an inner ferrule 102 clamped onto the hose 20. A grounding brad 104 projects from the ferrule and into the hose 20. The outer hose tubing **20*a* of the hose 20 is inserted onto an outer hose crimp adapter 106 which has a series of outwardly projecting ridges 108 to engage the outer hose tubing 20*a*. The inner hose tubing 20*b* of the hose 20 is connected to the compatibility assembly 146 through an inner hose barb adapter 110 which has a number of outwardly projecting barbs 112 which engage the inner hose tubing 20*b*. The inner hose barb adapter 110 is threaded into the valve body 48 and sealed with an O-ring 114. Likewise, the outer hose crimp adapter 106 is threaded to the valve body 48 and sealed with an O-ring 116. The primary purpose of the O-rings is to maintain a sealed separation between the fuel flow passage 26 in the outer hose tubing 20*a* from the vapor flow passage 32 in the inner hose tubing 20*b* through the assembly 146**.

The upstream end 52 of the compatibility assembly 146 includes an axially projecting nozzle inner adapter 118, which defines the central axial passageway 138, and a pair of O-rings 120 mounted on the nozzle inner adapter 118 for sealingly engaging the nozzle 14. A nozzle outer adapter 122 is concentrically mounted around the inner adapter 118 and has an annular groove 124 to receive therein a snap ring 126. The snap ring 126 retains a swivel nut 128 and a bearing sleeve 130. The swivel nut 128 includes a series of threads 132 for engaging a compatible coupling (not shown) for connection with the nozzle 14 when installing the compatibility assembly 146. An O-ring 134 is mounted around the swivel nut 128 for sealing engagement. A swivel seal 136 is captured by the swivel nut 128 to allow for rotation of the compatibility assembly 146 relative to the adjacent component.

The inner adapter 118 defines the central axial passageway 138 in communication with the primary vapor passage 50 for extracting vapors from the vehicle tank 18 through the compatibility assembly 146 when the vehicle 10 does not include an ORVR system 40. However, during refueling of an ORVR equipped vehicle, a valve assembly 56 in the valve body 48 is exposed to increased vacuum levels in the primary vapor passage 50 so that the bias of the spring 74 is overcome to thereby move the valve assembly 56 to a second closed position blocking the downstream end 54 of the primary vapor passage 50 and preventing communication with the ORVR system on the vehicle being refueled. The primary vapor passage 50 in the compatibility assembly 146 is then vented through the air bleed passage 94.

The valve assembly 56 is mounted for reciprocal movement in the valve body 48 and intersects the primary vapor passage 50 in the assembly 146. The valve assembly 56 may be a poppet type valve and include a sliding valve member 58 having a stem 59 separating a cup-shaped sealing disk 60' and an upper valve plate 72 which allows vapor flow through the primary vapor passage 50 when the valve assembly 56 is in a first position as shown in FIG. 5. The sliding valve member 58 reciprocates within a bore 64 containing the slotted passage 62 in the valve body 48 to a second position (not shown in FIG. 5) in which the cup-shaped sealing disk 60' of the valve member 58 blocks the slotted passage 62 to block or inhibit the vapor flow through the primary vapor passage 50.

An upper, proximal end 66 of the valve member 58 includes the plate 72. The coil spring 74 is mounted between the plate 72 on the valve member 58 and an annular socket 76 in a valve cap 140 which is seated in the valve body 48. In one embodiment, the spring 74 is a closed end, compression spring made of 302/304 stainless steel. Further, the spring 74 in one embodiment has a free length of 1.00 inch, a solid height of 0.503 inch and a spring rate of 0.0165 pounds/inch. In one embodiment, the valve member 58 is made from Delrin AF (Delrin acetal resin). The valve cap 140 is rotationally centered in the valve body 48 by a roll pin 142. The spring 74 urges or biases the valve member 58 downwardly so that the valve assembly 56 is urged toward the first position shown in FIG. 5.

A distal end 80 of the valve member 58 includes a plug-shaped stop 82 received within the air bleed passage 94 in the valve body 48. A V-shaped sealing ring or V-ring 84 is seated on the valve member 58 between the stop 82 and the cup-shaped sealing disk 60' for sealing the air bleed passage 94 and air bleed port 92 in the valve body 48. In the first position of the valve assembly 56 shown in FIG. 5, the V-ring 84 and stop 82 are seated against the valve body 48 and received within the air bleed passage 94, respectively, to seal off the air bleed port 92. The air bleed passage 94 is in communication with the primary vapor passage 50 upstream from the valve assembly 56. In the second position of the valve assembly 56, the valve member 58 is raised so that the V-ring 84 is unseated from the valve body 48, unsealing the air bleed port 92 so that ambient air is communicated through the air bleed passage 94 to the primary vapor passage 50.

In operation, the force of the spring 74 on the plate 72 keeps the valve member 58 in the first position as shown in FIG. 5 when refueling non-ORVR vehicles so that the primary passage 50 in the assembly 146 is unobstructed since the slotted passage 62 is unblocked and the air bleed port 92 is closed. When refueling non-ORVR vehicles, the vapor recovery system 24 in the fueling system 12 retrieves fuel vapors from the vehicle fuel tank 18 and pumps them to the ullage in the underground storage tank 30.

When refueling ORVR equipped vehicles, such as the vehicle 10, elevated vacuum levels in the primary vapor passage 50 result from the vacuum pump 38 in the vapor recovery system 24 in combination with the ORVR systems of the vehicles. The elevated vacuum levels are communicated through the primary vapor passages 50 to the chamber 70 in the valve body 48 in communication with the valve member 58. As a result of the elevated vacuum levels (or reduced pressure) in the chamber 70, the valve member 58 moves upward with the plate 72 moving upward and compressing the spring 74. The movement of the valve member 58 toward the second position in opposition to the bias of the spring 74 continues while the reduced pressure or elevated vacuum condition exists in the chamber 70. In one embodiment, the valve member 58 moves to the second position in response to a vacuum of about −0.5 inches $H_2O$ to about −4.0 inches $H_2O$. When a predetermined vacuum level is reached, the valve member 58 moves to the second position and then returns to the first position when the vacuum level is reduced below the predetermined vacuum level. These vacuum levels vary depending upon operating conditions and selected parameters for the assembly 146.

As a result of the movement of the plate 72, compression of the spring 74 and translation of the valve member 58, passage of vapor through the primary vapor passage 50 through the assembly 146 is blocked or hindered by the cup-shaped sealing disk 60' blocking the slotted passage 62. Moreover, the vacuum of the vapor recovery system 24 is also blocked or hindered from communicating with the ORVR system 40. Thus, the valve member 58 in the second position blocks off the primary vapor passage 50 from the vacuum pump 38 of the vapor recovery system 24 and opens up the air bleed port 92 to the primary vapor passage 50. The size of the air bleed port 92 can be adjusted for compatibility with the entrainment pumping action of ORVR systems to maintain the desired vacuum level in the passage 50 to keep the valve member 58 in the second position. Once refueling of a vehicle having an ORVR system concludes, the vacuum level in the chamber is reduced and the force of the spring 74 once again urges the valve member 58 downward so that the V-ring 84 engages the valve body 48 to close the air bleed port 92 and the primary vapor passage 50 is opened through the compatibility assembly 46.

A fourth embodiment of an ORVR compatibility assembly 200 according to the invention of the present application is shown in FIGS. 6-10. The ORVR compatibility assembly 200 has a housing body 202 with a primary vapor passage 204 extending therethrough via an inner nozzle adapter 206 and an inner hose barb adapter 208. The primary vapor passage 204 is in communication at one end with a vapor passage in a fuel delivery hose (not shown) via the inner hose barb adapter 208 and at the other end with a vapor passage in a fuel delivery nozzle (not shown) via the inner nozzle adapter 206. Vapor may be conveyed from a vehicle fuel tank through the nozzle, the primary vapor passage 204 and the hose to a fuel storage tank. From a vapor flow standpoint, the end of the body 202 in communication with the nozzle and the vehicle fuel tank is referred to as the upstream end 210 and the end of the body 202 in communication with the fuel storage tank is referred to as the downstream end 212.

A poppet valve assembly 214 is positioned in the body 202 to intersect the primary vapor passage 204. The poppet valve assembly 214 includes a generally cylindrical sliding poppet valve 216 which is mounted for reciprocating movement within the body 202. The poppet valve 216 has a first portion 218 from which a skirt 220 extends and a second portion 222 from which an annular plate 223 extends. The second portion 222 and the plate 223 position and receive a spring 224 which biases the poppet valve 216 toward a first position wherein the primary vapor passage 204 is open and vapor can freely flow through the vacuum relief valve in the direction indicated by the arrows. The force of the spring 224 is sufficient to maintain the poppet valve 216 in its first position regardless of the orientation of the ORVR compatibility assembly 200.

When an ORVR equipped vehicle is being refueled, the poppet valve 216 moves toward a second position wherein the primary vapor passage 204 is blocked. In the second position, the skirt 220 of the poppet valve 216 is positioned to close a slotted passage 226 in the body 202 that otherwise connects the downstream end 212 of the primary vapor passage 204 to the upstream end 210 of the primary vapor passage 204. Closing the passage 226 blocks or inhibits vapor flow through the primary vapor passage 204. During normal operation of the vacuum relief valve, the poppet valve 216 reciprocates within a bore 228 of the body 202 so that the flow of vapor through the primary vapor passage 204 is substantially unobstructed when a non-ORVR equipped vehicle is refueled or substantially blocked or inhibited when an ORVR equipped vehicle is refueled.

The ORVR compatibility assembly 200 further comprises a poppet valve diaphragm assembly 230 which separates a chamber 245 into first and second portions 246, 248 which can be considered to be first and second chambers. The poppet valve diaphragm assembly 230 comprises a diaphragm 232 and a poppet valve 234 centrally mounted thereon. The poppet valve 234 includes a sealing member 236, such as an O-ring as illustrated. The combination of the poppet valve 234 and sealing member 236 are sized to close an opening 237 of an air bleed passage 238 that communicates with the first portion 218 of the poppet valve 216 extending beyond an open side of the skirt 220 when the poppet valve diaphragm assembly 230 is in a first position. A conical spring 240 is mounted in the first portion 246 of the chamber 245 between the poppet valve diaphragm assembly 230 and a diaphragm cap 242 secured to the body 202. The spring 240 urges or biases the poppet valve diaphragm assembly 230, and hence the poppet valve 234, to the first position so that the opening 237 of the air bleed passage 238 is closed.

A secondary vapor passage 244 communicates the downstream end of the primary vapor passage 204 with a first portion 246 of the chamber 245 that houses the spring 240 and extends between the poppet valve diaphragm assembly 230 and the diaphragm cap 242. Alternately (or possibly additionally), the secondary vapor passage 244 may communicate the upstream end of the primary vapor passage 204 with the first portion 246 of the chamber 245, see 247. A second portion 248 of the chamber 245 is in communication with ambient air surrounding the ORVR compatibility assembly 200 via air bleed ports 250, 252 through the body 202, see FIG. 10.

When refueling non-ORVR vehicles, the force of the spring 240 on the poppet valve diaphragm assembly 230 keeps the opening 237 of the air bleed passage 238 closed and the force of the spring 224 on the plate 223 keeps the poppet valve 216 in its first position. Accordingly, the primary vapor passage 204 through the ORVR compatibility assembly 200 is unobstructed. Thus, when refueling non-ORVR vehicles, the vapor recovery system 24 in the fueling system 12 draws fuel vapors from the vehicle fuel tank 18 and pumps them to the fuel storage tank 30.

When refueling an ORVR equipped vehicle, elevated vacuum levels in the primary vapor passage 204 result from the vacuum pump of the vapor recovery system of the fueling system in combination with the ORVR system of the vehicle. The elevated vacuum levels are communicated through the primary and secondary vapor passages 204, 244 to the first portion 246 of the chamber 245. As a result of the elevated vacuum levels in the first portion 246 of the chamber 245, the diaphragm 232 and the poppet valve 234 move toward the diaphragm cap 242 to a second position unseating the sealing member 236 from the opening 237 of the air bleed passage 238 so that air at ambient (atmospheric) pressure enters the air bleed passage 238. Air flow through the air bleed passage 238 and the vacuum level in the primary vapor passage 204 cause the poppet valve 216 to move from its first position to its second position so that the skirt 220 closes the opening 226 to block or inhibit flow through the primary vapor passage 204. Since the secondary vapor passage 244 is connected to the vacuum pump in the vapor recovery system in the fueling system, the poppet valve 216 will remain in its second position until the vacuum pump is stopped. Thus, for ORVR equipped vehicles, the vacuum of the vapor recovery system in the fueling system is blocked from communicating with the ORVR system.

The secondary passage 244 also can be connected to the upstream end of the vapor path 204, i.e., to the nozzle side of the ORVR compatibility assembly 200, see 247. If so, the movement of the poppet valve 216 is modulated by the vacuum level in the neck of the vehicle fuel tank so that the poppet valve 216 tends to reciprocate within the bore 228 between its first and second positions depending on current fueling conditions. For this alternate, the size of the air bleed ports 250, 252 can be adjusted for compatibility with the entrainment pumping action of filler necks of ORVR equipped vehicles to maintain the desired vacuum level in the passage 204 so that the poppet valve 216 is maintained in its second position during a desired range of fuel pumping rates.

As a result of the movement of the poppet valve 216, the vacuum of the vapor recovery system of the fueling system is blocked from communicating with the ORVR equipped vehicle. To prevent the vacuum in the filler necks of ORVR vehicles being refueled from becoming so high that automatic shut off systems of refueling nozzles are activated, air is bled into the upstream end of the vapor passage 204 via the air bleed ports 250, 252, the opening 237 and the air bleed passage 238. One or more check valves 254 can be associated with the air bleed ports 250, 252.

Figure 11:
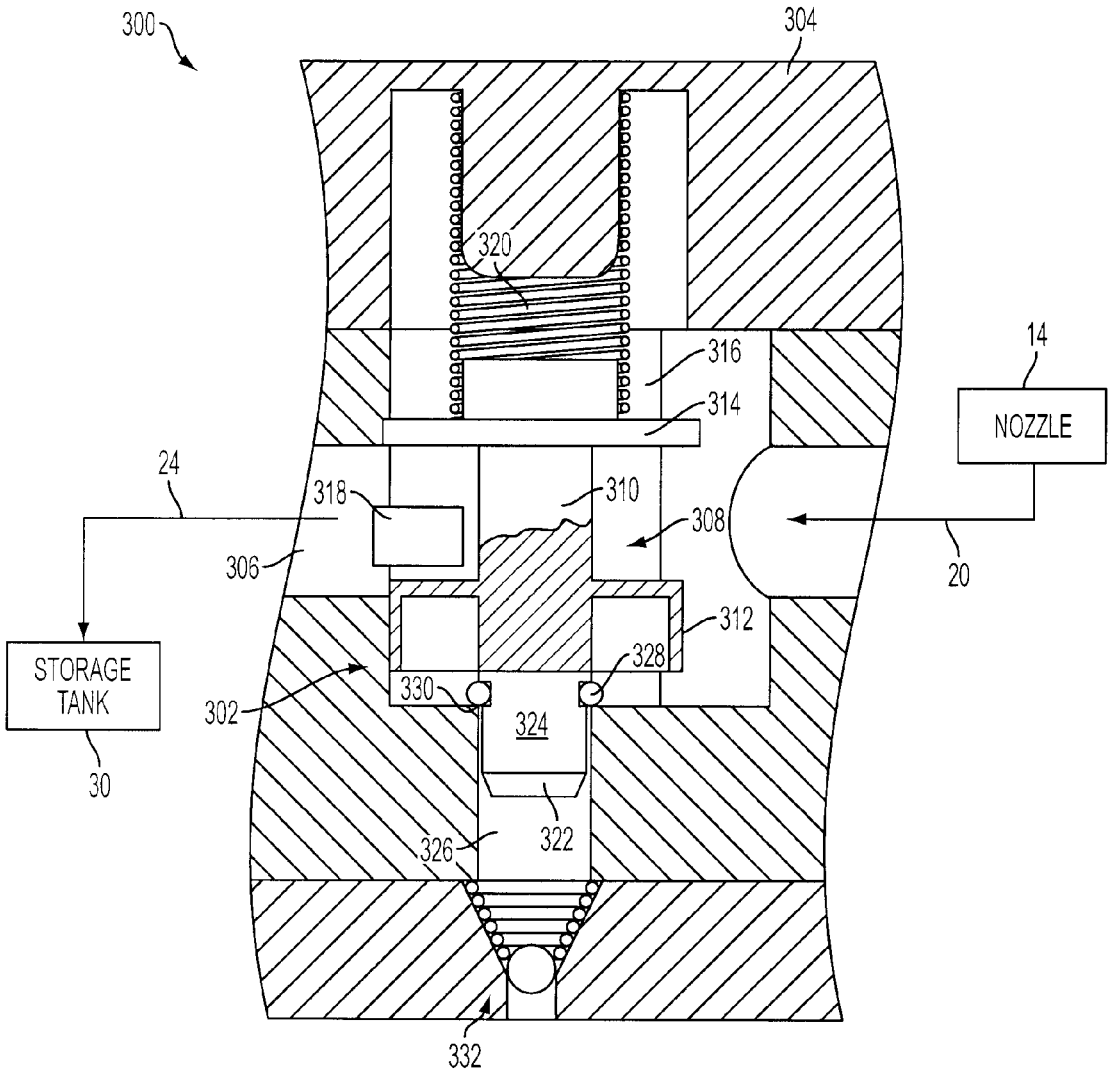
FIG. 11 is a schematic, sectional view partially broken-away of a fifth embodiment of an assembly for use in a vapor recovery system of the fueling system of FIG. 1.

A fifth embodiment of an ORVR compatibility assembly 300 according to the invention of the present application is shown in FIG. 11. For ease of illustration, only the central portion of the assembly 300 is shown. In FIG. 11, a valve assembly 302 is mounted for reciprocal movement in a valve body 304 and intersects a primary vapor passage 306 in the assembly 300. The valve assembly 302 may be a poppet type valve and include a sliding valve member 308 having a stem 310 separating a cup-shaped sealing disk 312 and a valve plate 314. The valve assembly 302 allows vapor flow through the primary vapor passage 306 when the valve assembly 302 is in a first position as shown in FIG. 11. The sliding valve member 308 reciprocates within a bore 316 containing a slotted passage 318 in the valve body 304 from the first position to a second position (not shown) in which the cup-shaped sealing disk 312 of the valve member 308 blocks the slotted passage 318 to block or inhibit the vapor flow through the primary vapor passage 306.

A coil spring 320 is mounted within the valve body 304 to bias the plate 314 and thereby the sliding valve member 308 to the first position shown in FIG. 11. The end 322 of the valve member 308 opposite to the valve plate 314 includes a plug-shaped stop 324 received within an air bleed passage 326 in the valve body 304. A sealing member, illustrated in FIG. 11 as an O-ring 328, is seated on the valve member 308 between the stop 324 and the cup-shaped sealing disk 312 for sealing the air bleed passage 326 and an air bleed port 330 in the valve body 304. In the first position of the valve assembly 302 shown in FIG. 11, the O-ring 328 is seated against the air bleed port 330 and the stop 324 is received within the air bleed passage 326 to seal off the air bleed port 330 and close the air bleed passage 326. The air bleed passage 326 is in communication with the primary vapor passage 306 upstream from the valve assembly 302. In the second position of the valve assembly 302, the valve member 308 is raised and the O-ring 328 is unseated so that the air bleed port 330 is unsealed and ambient air is communicated through the air bleed passage 326 to the primary vapor passage 306.

In operation, the force of the spring 320 on the plate 314 keeps the valve member 308 in the first position as shown in FIG. 11 when refueling non-ORVR vehicles so that the primary passage 306 in the assembly 300 is unobstructed by the sealing disk 312 and the air bleed port 330 is closed. When refueling non-ORVR vehicles, the vapor recovery system 24 in the fueling system 12 retrieves fuel vapors from the vehicle fuel tank 18 and pumps them to the ullage in the underground storage tank 30.

When refueling ORVR equipped vehicles, such as the vehicle 10, elevated vacuum levels in the primary vapor passage 306 result from the vacuum pump 38 in the vapor recovery system 24 in combination with the ORVR systems of the vehicles. As a result of the elevated vacuum levels (or reduced pressure), the valve member 308 moves upward with the plate 314 moving upward and compressing the spring 320. The movement of the valve member 308 toward the second position in opposition to the bias of the spring 320 continues while the reduced pressure or elevated vacuum condition exists. In one embodiment, the valve member 308 moves to the second position in response to a vacuum of about −0.5 inches $H_2O$ to about −4.0 inches $H_2O$. When a predetermined vacuum level is reached, the valve member 308 moves to the second position and then returns to the first position when the vacuum level is reduced below the predetermined vacuum level. These vacuum levels vary depending upon operating conditions and selected parameters for the assembly 300.

As a result of the movement of the plate 314, compression of the spring 320 and translation of the valve member 308 to the second position, the flow of vapor through the primary vapor passage 306 is blocked or hindered by the cup-shaped sealing disk 312 blocking the slotted passage 318. Moreover, the vacuum of the vapor recovery system 24 is also blocked or hindered from communicating with the ORVR system 40. Thus, the valve member 308 in the second position blocks off the upstream end of the primary vapor passage 306 from the vacuum pump 38 of the vapor recovery system 24 and opens up the air bleed port 330 to the upstream end of the primary vapor passage 306. The size of the air bleed port 330 can be adjusted for compatibility with the entrainment pumping action of ORVR systems to maintain the desired vacuum level in the upstream end of the primary vapor passage 306 to keep the valve member 308 in the second position. Once refueling of a vehicle having an ORVR system concludes, the vacuum level in the upstream end of the primary vapor passage 306 is reduced and the force of the spring 320 once again urges the valve member 308 to its first position so that the O-ring 328 closes the air bleed port 330 and the primary vapor passage 306 is opened through the ORVR compatibility assembly 300. A check valve, illustrated in FIG. 11 as a ball check valve 332, can also be used in addition to or in place of the O-ring 328.

Figure 12:
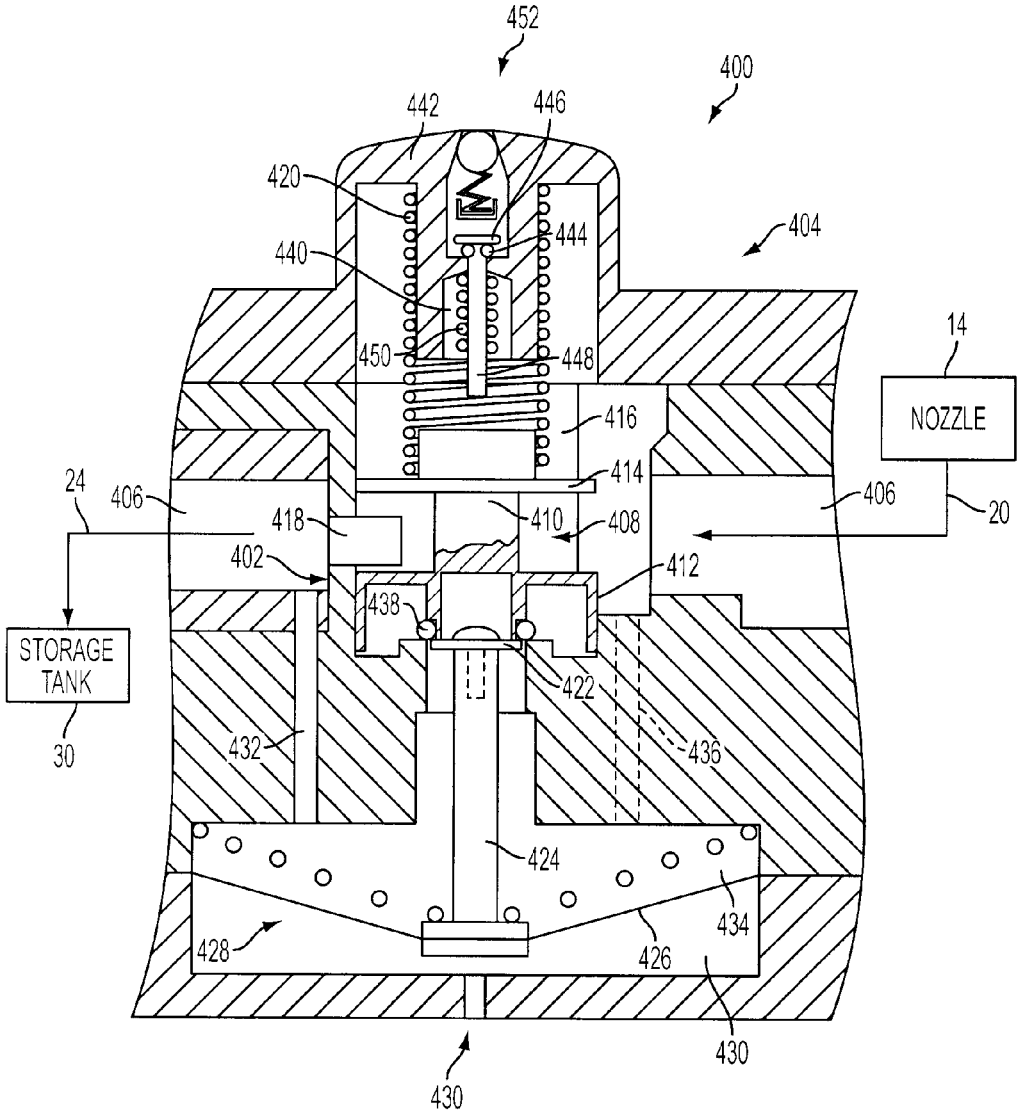
FIG. 12 is schematic, sectional view partially broken-away of a sixth embodiment of an assembly for use in a vapor recovery system of the fueling system of FIG. 1.

A sixth embodiment of an ORVR compatibility assembly 400 according to the invention of the present application is shown in FIG. 12. For ease of illustration, only the central portion of the assembly 400 is shown. In FIG. 12, a valve assembly 402 is mounted for reciprocal movement in a valve body 404 and intersects a primary vapor passage 406 in the assembly 400. The valve assembly 402 may be a poppet type valve and include a sliding valve member 408 having a stem 410 separating a cup-shaped sealing disk 412 and a valve plate 414. The valve assembly 402 allows vapor flow through the primary vapor passage 406 when the valve assembly 402 is in a first position as shown in FIG. 12. The sliding valve member 408 reciprocates within a bore 416 containing a slotted passage 418 in the valve body 404 from the first position to a second position (not shown) in which the cup-shaped sealing disk 412 of the valve member 408 blocks the slotted passage 418 to block or inhibit the vapor flow through the primary vapor passage 406.

A coil spring 420 is mounted within the valve body 404 to bias the plate 414 and thereby the sliding valve member 408 to the first position shown in FIG. 12. One end 422 of the valve member 408 opposite to the valve plate 414 is coupled to one end of a shaft 424 which has its opposite end coupled to a diaphragm 426 mounted within a chamber 428. A first portion 430 of the chamber 428 is open to atmosphere as indicated at 430. A secondary vapor passage 432 is in fluid communication with a second portion 434 of the chamber 428 and the primary vapor passage 406 on the downstream end of the passage 406. Alternately, the secondary vapor passage 432 can be in communication with the upstream end of the primary vapor passage as indicated at 436. A sealing ring, illustrated in FIG. 12 as an O-ring 438, is seated on the valve member 408 for sealing the second portion 434 of the chamber 428 from the primary vapor passage 406.

An air bleed passage 440 located in an end piece 442 that closes the valve body 404 is in communication with the primary vapor passage 406. A sealing member, illustrated as an O-ring 444, is seated on a beveled surface of a stop 446 formed on the distal end of a stem 448 to close the air bleed passage 440 when the stem 448 is in a first position shown in FIG. 12. The stem 448 is biased to its first position by a spring 450 to close the air bleed passage 440. In a second position of the stem 448, the stem 448 is moved against the force of the spring 450 so that the O-ring 444 is unseated and the air bleed passage 440 is open to ambient air which is communicated to the primary vapor passage 406. The stem 448 and hence the stop 446 and the O-ring 444 are moved by physical contact of the stem 448 with the sliding valve member 408. As illustrated, the stem 448 is spaced from the sliding valve member when both are in their first positions, i.e., the primary vapor passage 406 is open and the air bleed passage 440 is closed. In this way, there is a delay between the closure of the primary vapor passage 406 and the opening of the air bleed passage 440 to ensure that the primary vapor passage 406 is closed before ambient air is bled into the primary vapor passage 406 to flow to the nozzle.

In operation, the force of the spring 420 on the plate 414 keeps the valve member 408 in the first position as shown in FIG. 12 when refueling non-ORVR vehicles. Accordingly, the primary passage 406 in the assembly 400 is unobstructed since the sealing disk 412 is clear of the slotted passage 418 and the air bleed passage 440 also is closed. When refueling non-ORVR vehicles, the vapor recovery system 24 in the fueling system 12 retrieves fuel vapors from the vehicle fuel tank 18 and pumps them to the ullage in the underground storage tank 30.

When refueling ORVR equipped vehicles, such as the vehicle 10, elevated vacuum levels in the primary vapor passage 406 result from the vacuum pump 38 in the vapor recovery system 24 in combination with the ORVR systems of the vehicles. As a result of the elevated vacuum levels (or reduced pressure), the valve member 408 moves to a second position, upward as shown in FIG. 12, due to movement of the diaphragm 426 with the plate 414 moving upward and compressing the spring 420. Movement of the valve member 408 toward the second position in opposition to the bias of the spring 420 continues while the reduced pressure or elevated vacuum condition exists. In one embodiment, the valve member 408 moves to the second position in response to a vacuum of about −0.5 inches $H_2O$ to about −4.0 inches $H_2O$. When a predetermined vacuum level is reached, the valve member 408 moves to the second position and then returns to the first position when the vacuum level is reduced below the predetermined vacuum level. These vacuum levels vary depending upon operating conditions and selected parameters for the assembly 400.

As a result of the movement of the plate 414, compression of the spring 420 and translation of the valve member 408 to the second position, the flow of vapor through the primary vapor passage 406 is blocked or hindered by the cup-shaped sealing disk 412 blocking the slotted passage 418. Moreover, the vacuum of the vapor recovery system 24 is also blocked or hindered from communicating with the ORVR system 40. Thus, the valve member 408 in the second position blocks off the upstream end of the primary vapor passage 406 from the vacuum pump 38 of the vapor recovery system 24.

As the valve member 408 moves, it eventually reaches the stem 448 and further movement of the valve member 408 also moves the stem 448 against the force of the spring 450 to open up the air bleed passage 440 to the upstream end of the primary vapor passage 406. The size of the air bleed passage 440 can be adjusted for compatibility with the entrainment pumping action of ORVR systems to maintain the desired vacuum level in the upstream end of the primary vapor passage 406 to keep the valve member 408 in the second position. Once refueling of a vehicle having an ORVR system concludes, the vacuum level in the upstream end of the primary vapor passage 406 is reduced and the force of the spring 420 once again urges the valve member 408 toward its first position so that the primary vapor passage 406 is opened through the ORVR compatibility assembly 400. Movement of the valve member 408 enables the spring 450 to force the stem 448 to its first position so that the O-ring 444 closes the air bleed passage 440. A check valve, illustrated in FIG. 12 as a ball check valve 452, can also be used in addition to or in place of the O-ring 444.

The ORVR compatibility assemblies illustrated in the present application are used to reduce the amount of vapors emitted from a vehicle tank during refueling, i.e., the fuel dispensing process, and also the amount of vapors emitted from fuel storage tanks, particularly when ORVR equipped vehicles are refueled. While achievement of that goal should be apparent from a review of the above description, an additional aspect of reducing emissions to the atmosphere is to reduce the emissions of liquid fuel from the assemblies themselves to the atmosphere if liquid fuel is introduced into the primary vapor passage of the assemblies, for example due to a hose failure. More particular, if a failure of the fuel delivery hose 20 results in liquid fuel being passed from the annular fuel delivery passageway 26 to the central, tubular vapor passage 32, the assemblies should reduce or eliminate the release of liquid fuel from the assemblies themselves. Each of the embodiments should satisfy this requirement since when liquid fuel enters the tubular vapor passage 32, the vapor passage 32 is rapidly pressurized.

In the embodiments of FIGS. 1-4, the elevated vacuum levels (or reduced pressure) in the chamber 70 that moved the diaphragm 68 to the position shown in FIG. 3, are rapidly replaced by the pressure produced within the vapor passage 32 of the fuel delivery hose 20 which is passed to the primary vapor passage 50 and the chamber 70. As a result of the rapid pressurization of the chamber 70, the diaphragm 68 and the spring 74 force the sliding valve member 58 to rapidly move to the first position shown in FIGS. 2 and 4. This movement of the sliding valve member 58 moves the O-ring 84 seated on the beveled surface 86 of the stop 82 so that the O-ring 84 and the stop 82 are seated against the housing 48. In this position, the O-ring 84 and stop 82 seal off the air bleed port 92 connected to the air bleed passage 94 so that little or no liquid fuel can escape through the air bleed port 92 to atmosphere.

In the embodiment of FIG. 5, the elevated vacuum levels (or reduced pressure) in the chamber 70 that moved sliding valve member 58 to the second position are rapidly replaced by the pressure produced within the vapor passage 32 of the fuel delivery hose 20 which is passed to the primary vapor passage 50 and the chamber 70. As a result of the rapid pressurization of the chamber 70, the pressure and the spring 74 force the sliding valve member 58 to rapidly move to the first position shown in FIG. 5. This movement of the sliding valve member 58 moves the stop 82 and the V-ring 84 so that the V-ring engages the valve body 48 to close the air bleed port 92. In this position, the V-ring 84 and stop 82 seal off the air bleed port 92 connected to the air bleed passage 94 so that little or no liquid fuel can escape through the air bleed port 92 to atmosphere.

In the embodiment of FIGS. 6-10, the elevated vacuum levels (or reduced pressure) in the first portion 246 of the chamber 245 that moved the diaphragm 232 and the poppet valve 234 toward the diaphragm cap 242 are rapidly replaced by the pressure produced within the vapor passage 32 of the fuel delivery hose 20 which is passed to the primary vapor passage 204 and the first portion 246 of the chamber 245. As a result of the rapid pressurization of the first portion 246 of the chamber 245, the diaphragm 232 and the spring 240 force the diaphragm 232 and the poppet valve 234 to rapidly move to the first position shown in FIGS. 9 and 10. This movement of the diaphragm 232 and the poppet valve 234 forces the sealing member 236 to close the opening 237 of the air bleed passage 238. By sealing or closing the opening 237 of the air bleed passage 238, little or no liquid fuel can escape through the air bleed passage 234 to the second portion 230 of the chamber 245 and hence to atmosphere via the air bleed ports 250, 252. Check valves 254 can provide further protection against liquid fuel loss to the atmosphere.

In the embodiment of FIG. 11, the elevated vacuum levels (or reduced pressure) in the primary vapor passage 306 that moved sliding valve member 308 to the second position are rapidly replaced by the pressure produced within the vapor passage 32 of the fuel delivery hose 20 which is passed to the primary vapor passage 306. As a result of the rapid pressurization of the primary vapor passage 306, the pressure and the spring 320 force the sliding valve member 308 to rapidly move to the first position shown in FIG. 11. This movement of the sliding valve member 308 moves the stop 324 and the O-ring 328 so that the O-ring 328 engages the air bleed port 330 to close the air bleed port 330. In this position, the O-ring 328 and stop 324 seal off the air bleed passage 326 so that little or no liquid fuel can escape through the air bleed passage 326 to atmosphere. In the embodiment of FIG. 11, the check valve 332 used with the O-ring 328 further ensures that little or no liquid fuel can escape from the air bleed passage 326. If further assurance against liquid fuel loss is desired in any of the other embodiments of the assemblies illustrated in FIGS. 1-10, a check valve or check valves can be added to those embodiments, see for example the check valves 254 in FIG. 10 associated with the air bleed ports 250, 252. It is noted that the check valve 332 should also ensure that little or no liquid fuel can escape from the air bleed passage 326 if used alone, i.e., without the O-ring 328.

In the embodiment of FIG. 12, the elevated vacuum levels (or reduced pressure) in the primary vapor passage 406 that moved sliding valve member 408 to the second position are rapidly replaced by the pressure produced within the vapor passage 32 of the fuel delivery hose 20 which is passed to the primary vapor passage 406. As a result of the rapid pressurization of the primary vapor passage 406, the pressure and the spring 420 force the sliding valve member 408 to rapidly move to the first position shown in FIG. 12. This movement of the sliding valve member 408 and the force of the spring 450 moves the stem 448 and the O-ring 444 so that the O-ring 444 closes the air bleed passage 440. In this position, the O-ring 444 seals off the air bleed passage 440 so that little or no liquid fuel can escape through the air bleed passage 440 to atmosphere. In the embodiment of FIG. 12, the check valve 452 used with the O-ring 444 further ensures that little or no liquid fuel can escape from the air bleed passage 440. It is noted that the check valve 452 should also ensure that little or no liquid fuel can escape from the air bleed passage 440 if used alone, i.e., without the O-ring 444.

Additional aspects of this invention include the use of a sensor (not shown) to detect an ORVR refueling vent. In one aspect, the linear motion of the valve members of the ORVR compatibility assemblies is used as the basis for a transducer or sensor to detect an ORVR refueling event to consequently turn off or otherwise modulate the vapor pump 38 of the vapor recovery system 24 during an ORVR refueling event. The response time of the valve members is quick enough that the resulting reduction in vapor (air) flow through the primary vapor passage 50 would be at or near 100%.

Moreover, the invention of the present application could be utilized in combination with an ORVR nozzle as described in U.S. patent application Ser. No. 10/820,288 filed on Apr. 8, 2004 which claims priority to U.S. Provisional Patent Application Ser. No. 60/461,097, both of which are incorporated herein by reference. The retrofit of an existing fuel system 12 to accomplish such an improvement is a simple matter of hanging a new valve and nozzle assemble in the fuel system. It should be appreciated by those of ordinary skill in the art that the retrofit of existing fuel systems is easily accomplished with the implementation and installation of ORVR compatibility assemblies as described herein. Additionally, the installation of new fuel systems preferably includes ORVR compatibility assemblies as incorporated into the fuel nozzle, in communication with the hose or anywhere in the vapor recovery system of the fueling system.

From the above disclosure of the general principles of the present invention and the preceding detailed description of at least one preferred embodiment, those skilled in the art will readily comprehend various modifications to which this invention is susceptible. Therefore, I desire to be limited only by the scope of the following claims and equivalents thereof.

What is claimed is:

1. An ORVR compatibility assembly for use in a fueling system in which fuel from a storage tank is pumped through a hose to a nozzle for discharge into a fuel tank of a vehicle, the fueling system including a vapor recovery system to recover fuel vapors displaced from the fuel tank during fueling, the assembly comprising:

a primary vapor passage adapted to be in fluid communication with the vapor recovery system;

a valve assembly moveable between first and second positions, the first position permitting the uninterrupted flow of vapors through the primary vapor passage and the second position inhibiting the flow of vapors through the primary vapor passage, the valve assembly being biased toward the first position;

a diaphragm mounted within a chamber;

a sealing member coupled to the diaphragm;

a secondary vapor passage in fluid communication with a first side of the diaphragm and the primary vapor passage;

an air bleed passage communicating a second side of the diaphragm and the valve assembly;

the diaphragm being moveable between open and closed positions, the sealing member in the closed position closing the air bleed passage and in the open position opening the air bleed passage to ambient atmosphere, the diaphragm being biased toward the closed position; and wherein when the pressure on the first side of the diaphragm is reduced to a predetermined level, the diaphragm with the sealing member moves from the closed position to the open position so that the valve assembly is moved from its first position to its second position to inhibit flow through the primary vapor passage and vent the primary vapor passage through the air bleed passage when the diaphragm with the sealing member moves to the open position.

2. The assembly of claim 1 wherein the second side of the diaphragm is vented to ambient atmosphere through at least one air bleed port.

3. The assembly of claim 2 wherein a check valve is mounted in the at least one air bleed port.

4. The assembly of claim 1 wherein the valve assembly comprises:

a valve member having a valve passage aligned with the primary vapor passage and through which vapors flow when the valve assembly is in the first position; and a valve body having a bore in which the valve member is seated for reciprocal movement to and between the first and second positions.

5. The assembly of claim 1 wherein the sealing member comprises an O-ring for closing the air bleed passage.

6. The assembly of claim 1 wherein the secondary vapor passage is in fluid communication with a downstream end of the primary vapor passage.

7. The assembly of claim 1 wherein the secondary vapor passage is in fluid communication with an upstream end of the primary vapor passage.

8. An ORVR compatibility assembly for use in a fueling system in which fuel from a storage tank is pumped through a hose to a nozzle for discharge into a fuel tank of a vehicle, the fueling system including a vapor recovery system to recover fuel vapors displaced from the fuel tank during fueling, the assembly comprising:

a primary vapor passage adapted to be in fluid communication with the vapor recovery system;

a valve assembly moveable between first and second positions, the first position permitting the uninterrupted flow of vapors through the primary vapor passage and the second position inhibiting the flow of vapors through the primary vapor passage, the valve assembly being biased toward the first position;

an air bleed passage in fluid communication with the primary vapor passage;

a sealing member associated with the air bleed passage and moveable between open and closed positions, the sealing member in the closed position closing the air bleed passage;

a diaphragm mounted within a chamber, the sealing member being mounted on the diaphragm which is moveable between open and closed positions to move the sealing member between its open and closed positions, the diaphragm being biased toward the closed position;

a secondary vapor passage in fluid communication with a first side of the diaphragm and the primary vapor passage;

the air bleed passage communicating a second side of the diaphragm and the valve assembly; and wherein when the air pressure in the primary vapor passage is reduced to a predetermined level, the sealing member moves to the open position, the valve assembly moves from the first position to the second position and the primary vapor passage is vented through the air bleed passage.

9. An ORVR compatibility assembly for use in a fueling system in which fuel from a storage tank is pumped through a hose to a nozzle for discharge into a fuel tank of a vehicle, the fueling system including a vapor recovery system to process fuel vapors displaced from the fuel tank during fueling, the assembly comprising:

a primary vapor passage adapted to be in fluid communication with the vapor recovery system;

a valve assembly moveable between first and second positions, the first position permitting the uninterrupted flow of vapors through the primary vapor passage and the second position inhibiting the flow of vapors through the primary vapor passage, the valve assembly being biased toward the first position;

a diaphragm mounted within a chamber and coupled to the valve assembly;

a secondary vapor passage in fluid communication with the chamber and the primary vapor passage;

an air bleed passage in fluid communication at a first end with the primary vapor passage; and a sealing member moveable between open and closed positions, the sealing member in the closed position sealing a second end of the air bleed passage, the sealing member in the open position opening the second end to ambient atmosphere when the valve assembly is in the second position, the sealing member being moved between the closed and open positions by the valve assembly moving between the first position and the second position;

wherein when the air pressure in the chamber is reduced to a predetermined level the diaphragm and the valve assembly coupled thereto move from the first position to the second position and thereby inhibit flow in the valve assembly through the primary vapor passage and vent the primary vapor passage through the air bleed passage when the sealing member is moved to the open position.

10. The assembly of claim 9 wherein the sealing member is moved by physical contact with the valve assembly as the valve assembly moves from the first position to the second position.

11. The assembly of claim 10 wherein the sealing member is spaced from the valve assembly so that there is a delay between closure of the primary vapor passage and opening of the air bleed passage.

12. The assembly of claim 9 wherein the air bleed passage includes a check valve.

13. The assembly of claim 9 wherein the secondary vapor passage is in fluid communication with the chamber at an upstream end of the primary vapor passage.

14. The assembly of claim 9 wherein the secondary vapor passage is in fluid communication with the chamber at a downstream end of the primary vapor passage.

* * * * *